US007299732B1

(12) United States Patent
Stone et al.

(10) Patent No.: US 7,299,732 B1
(45) Date of Patent: Nov. 27, 2007

(54) HONEYCOMB REMOVAL

(75) Inventors: M. Anthony Stone, Gurley, AL (US); Darcy J. Harbaugh, Huntsville, AL (US); Clifford V. Mitchell, Cullman, AL (US)

(73) Assignee: United Technologies Corporation, East Hartford, CT (US)

( * ) Notice: Subject to any disclaimer, the term of this patent is extended or adjusted under 35 U.S.C. 154(b) by 0 days.

(21) Appl. No.: 08/327,744

(22) Filed: Oct. 24, 1994

(51) Int. Cl.
*D26D 3/00* (2006.01)

(52) U.S. Cl. ..... 83/870; 83/53; 83/177; 134/22.18; 451/38

(58) Field of Classification Search ..... 83/53, 83/61, 83, 177, 870; 15/316.1; 451/38, 451/39, 40; 239/589; 134/22.12, 22.18, 134/24, 34

See application file for complete search history.

(56) References Cited

U.S. PATENT DOCUMENTS

| | | | | | |
|---|---|---|---|---|---|
| 2,015,875 | A | * | 10/1935 | Sloan | 451/40 |
| 3,720,021 | A | * | 3/1973 | Wada | 451/39 |
| 4,218,066 | A | * | 8/1980 | Ackermann | 277/53 |
| 4,409,054 | A | * | 10/1983 | Ryan | 156/293 |
| 4,433,845 | A | * | 2/1984 | Shiembob | 277/1 |
| 4,731,125 | A | * | 3/1988 | Carr | 451/39 |
| 4,806,172 | A | * | 2/1989 | Adaci et al. | 134/34 |
| 5,002,615 | A | * | 3/1991 | McGregor | 239/589 |
| 5,052,756 | A | * | 10/1991 | Wada et al. | 83/53 |
| 5,167,721 | A | * | 12/1992 | McComas et al. | 134/34 |
| 5,199,342 | A | * | 4/1993 | Hediger | 83/177 |

FOREIGN PATENT DOCUMENTS

| | | | | |
|---|---|---|---|---|
| EP | 207069 | * | 12/1986 | 83/177 |

OTHER PUBLICATIONS

"Abrasive Waterjets Come of Age", Machine Design, May 10, 1990.*

* cited by examiner

*Primary Examiner*—Boyer D. Ashley

(57) ABSTRACT

Honeycomb removal comprises directing a nozzle at the surface of a substrate at an angle of less than about 90° such that the water will strike the substrate at the base of the honeycomb, parallel to the direction of the ribbon which forms the honeycomb structure. Water then passes through the nozzle and through the orifice at a pressure and flow rate sufficient to remove the honeycomb and preferably the underlying braze from the substrate surface. Relative motion is created between the substrate and the nozzle such that the water stream advances to an area which honeycomb has not been removed with the stream continually being directed at the base of the honeycomb.

8 Claims, 3 Drawing Sheets

IE
100
75
50
25
IE avg
40
36
34
36A
32
38
30
0.000
0.500
1.000
Xo(4)
Xo(3)
Xo(2)
Xo(1)

HONEYCOMB REMOVAL

TECHNICAL FIELD

The present invention relates to the removal of coatings using a pressurized liquid, and especially relates to removing honeycomb from a substrate utilizing liquid under high pressures.

BACKGROUND OF THE INVENTION

A honeycomb structure is commonly used to form abradable seals such as between jet engine components including stators and blades. The honeycomb structure which is commonly composed of metals such as HASTELLOY™-X is typically formed with ribbon which is attached to the component with a braze generally comprised of metals such as nickel, chrome, and others, and various combinations thereof. During operation, the blades cut into the honeycomb, causing the honeycomb to form a seal around the blade tips (see U.S. Pat. No. 4,218,066, U.S. Pat. No. 4,409,054, and U.S. Pat. No. 4,433,845). Upon rework of the engine and the various components thereof, the honeycomb and braze are removed.

Conventionally, honeycomb removal has been accomplished via machining and grinding techniques, chemical immersion, and de-brazing with heat. These techniques which are mundane, manual, labor intensive, tedious processes, commonly result in irreparable component damage. For example, due to heat and other operating stresses, rework stators are typically not perfectly round. Machining and grinding techniques which fail to account for the irregular shape of the stators, often remove part of the metal forming the stator, rendering it unacceptable for further use in an engine.

What is needed in the art is an automated, efficient honeycomb removal process which does not damage the substrate.

DISCLOSURE OF THE INVENTION

The present invention relates to a method for removing honeycomb from a substrate which comprises directing a pressurized liquid at an angle of less than about 90° between the liquid and the article, through at least one orifice of a nozzle such that the liquid forms a liquid stream which strikes the article at the base of the honeycomb, thereby removing the honeycomb from the substrate.

The foregoing and other features and advantages of the present invention will become more apparent from the following description and accompanying drawings.

Figure 1:
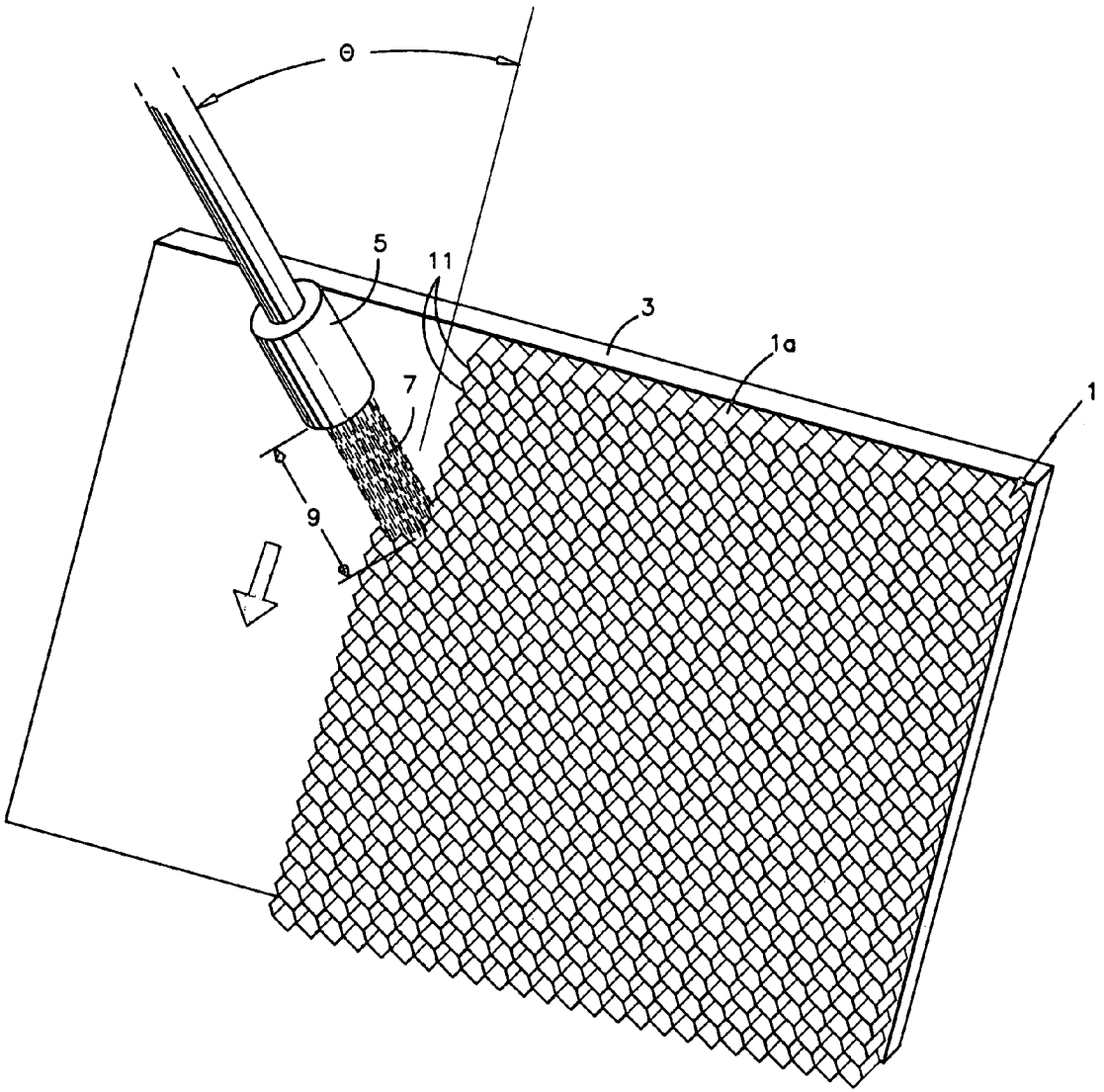
FIG. 1 is a perspective view of one embodiment of the honeycomb removal process of the present invention.

These drawings are to further illustrate the present invention and are not meant to limit the scope thereof.

BEST MODE FOR CARRYING OUT THE INVENTION

The present invention discloses a method for removing honeycomb and typically both honeycomb and braze from a substrate. This method employs a liquid supply and a nozzle having a bore(s) which connect a plenum chamber to an orifice(s). During operation, the nozzle is oriented at an angle θ of less than about 90° between the nozzle and the substrate such that a stream of pressurized water exiting the nozzle strikes the substrate at the base of the honeycomb, preferably in a direction parallel to the ribbon direction (see FIG. 1). Note, although water is described herein as the liquid sprayed from the nozzle for mostly environmental and economic reasons, virtually any sprayable liquid such as water-based liquids, conventional cleaning liquids, and others which can be spray with sufficient energy to remove the honeycomb, can be used.

The plenum chamber functions as a reservoir having a sufficient volume to both maintain the desired pressure and to supply sufficient liquid to each orifice, and preferably sufficient diameter to allow a direct path from the plenum chamber to each orifice without additional turns/bends in the liquid pathway. The plenum chamber and nozzle should be sized proportionally to provide a sufficient safety factor to prevent structural fracture due to over pressurization, while at the same time minimizing weight. For example, for up to an about 2 inch (50.8 millimeters (mm)) nozzle, the plenum chamber typically has a diameter of about 0.1 to about 0.4 inches (about 2.54 to about 10.16 mm) and a length of about 1 inch (25.4 mm) to about 4 inches (101.6 mm).

The plenum chamber supplies the water to the orifices via a series of bores. Each bore has a diameter sufficient to supply the desired flow rate of liquid to the orifice, a length sufficient to orient the water in a laminar flow pattern upon reaching the orifice to both improve coherency of the spray exiting the orifice and increase the spray energy, and preferably a geometry and relatively smooth walls to enhance that laminar flow. Increased energy and spray coherency allow greater stand-off distances (distance from the nozzle to the substrate), thereby allowing entry of the water stream into deeper areas of the substrate and larger acceptable deviations in part symmetry, higher removal rates, and increased process efficiency.

The bore size is currently bounded by the characteristics of the pump utilized to supply the water to the orifice, by the necessary pressure and flow rate, and the nozzle production restrictions such as orifice retainer size, orifice geometry, and retainer sealing design. Currently, engine part accessibility and maximum allowable nozzle weight determine the upper limit on the bore length. However, as the nozzle parts improve, i.e., stronger/lighter weight materials, better orifice retainers, improved seals, and alternative designs, the preferred bore size may increase and bore length change to allow higher flow capacity and lower water stream turbulence. The bore diameter and length, which can readily be determined by an artisan, is typically about 0.05 to about 0.2 inches (about 1.27 to about 5.08 mm) and up to about 5 inches (about 127 mm), respectively, with about 0.094 to about 0.13 inches (about 2.39 to about 3.30 mm) and about 1.0 to about 4 inches (about 25.4 to about 101.6 mm), respectively, preferred. In general, bore length to bore diameter ratios of about 24:1 are employed, although other ratios can be used depending on the honeycomb and braze materials. For example, a one orifice nozzle which was successful in the removal of honeycomb materials, has a bore length to bore diameter ratio of 24:1 and uses one orifice.

With respect to the bore geometry, tubular shaped bores are commonly utilized, with substantially conical shaped bores, converging in the direction of the liquid flow, i.e. from the plenum chamber to the orifices, preferred. Typically the degree which the conical bore walls converge is up to about 25°, with about 10° to about 15° preferred.

The orifices, which receive water from the plenum chamber via the bores, have a size and location based upon the preferred even energy distribution of water across the swath (water contact area). This even energy distribution is a function of the nozzle orifice distribution and the orifice diameter. Since the overall energy of the distribution is affected by the orifice size, water pressure, stand-off distance, nozzle travel velocity, and nozzle rotation rate, control of these parameters is very important in ensuring proper energy distribution and uniform stripping. As is disclosed in co-pending patent application, U.S. Ser. No. 07/922,590, (incorporated herein by reference), the orifices are typically distributed across the face of the nozzle such that, moving from the center of the nozzle to the outer edge, the distance between adjacent orifices generally decreases while the orifice diameter generally increases. These orifice orientations and diameters are selected in order to attain a substantially uniform cleaning intensity magnitude upon rotation and translation of the nozzle.

For instance, if a nozzle having a single orifice located one inch from the center thereof (or multiple orifices all oriented one inch from the center thereof) is rotated as it traverses a substrate surface, the areas of the swath will be exposed to uneven cleaning forces such that the edges of the swath will experience a high intensity magnitude while the center of the nozzle will experience a low intensity magnitude. (see FIG. 2 line 30) In other words, the center of the swath will not be sufficiently cleaned, with a strip of contaminants remaining in the center of the swath, while the edges of the swath will be cleaned, or the center of the swath will be cleaned while the edges of the swath may show substrate damage due to the high intensity of the energy striking those locations.

Similarly, if multiple orifices having the same diameter are oriented on the nozzle at different distances from the center of the nozzle, the intensity magnitude will still vary across the swath, as shown in line 32, with a peak corresponding to each orifice instead of one peak as in line 30. The orifice closest to the center of the nozzle will create a high intensity magnitude, and the orifices further from the center of the nozzle will produce decreasing intensity magnitudes. In this instance, the center of the swath, which corresponds to the area 34 of line 36, and the edges of the swath, corresponding to peaks 36A and 38, will have a relatively low intensity magnitude and therefore will not be sufficiently cleaned by the water spray or if cleaned, the area of the swath corresponding to the peaks, particularly the highest peak 40, may be damaged. Essentially, this nozzle will either leave streaks of honeycomb on the surface of the substrate or potentially damage the substrate.

Figure 2:
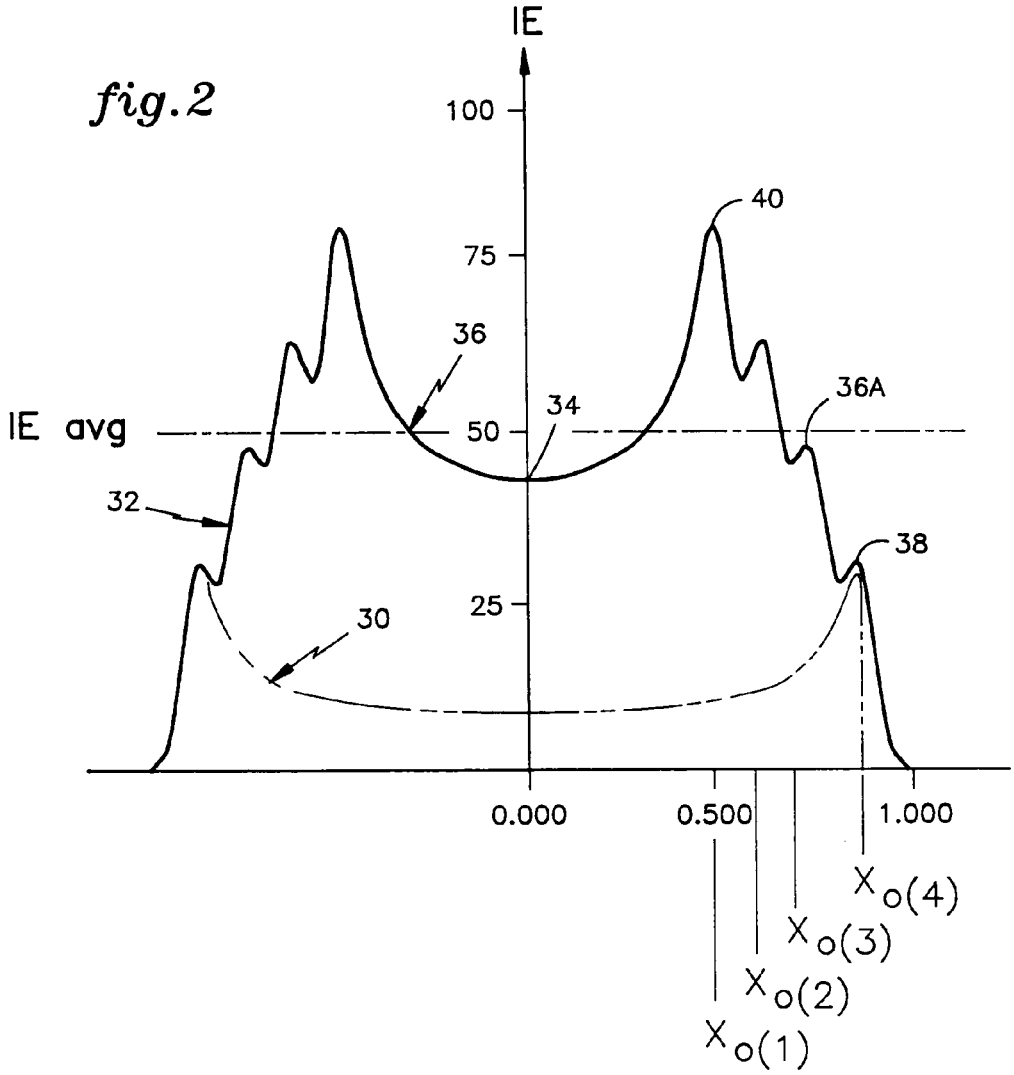
FIG. 2 is an illustration of the incident energy of a conventional rotating nozzle which traverses the surface of a substrate.
Figure 3:
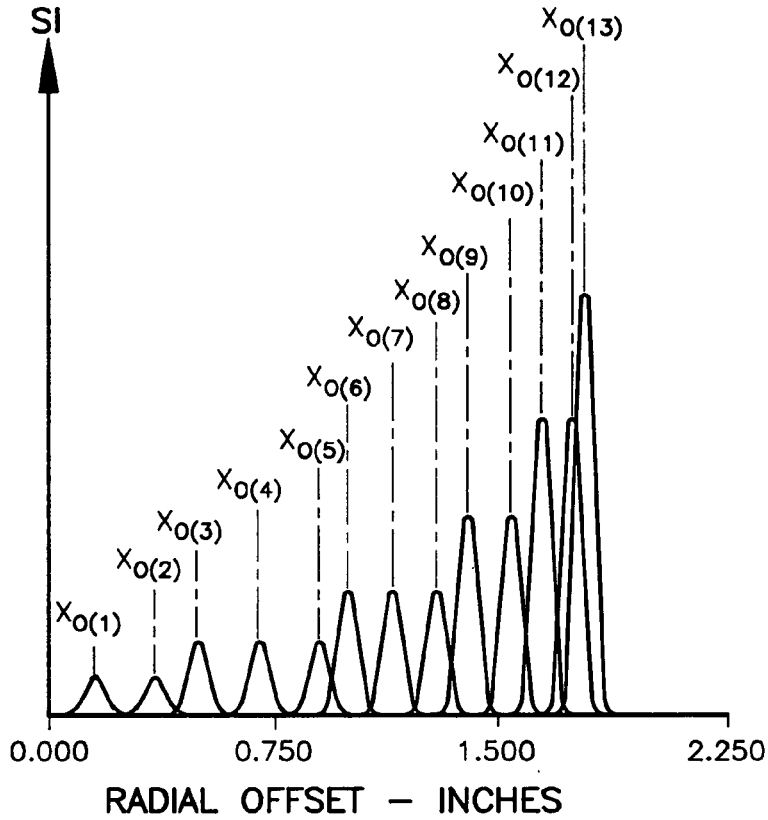
FIG. 3 is an illustration of the magnitude spectrum showing individual orifice intensity distributions for a nozzle which exhibits an even energy profile.
Figure 4:
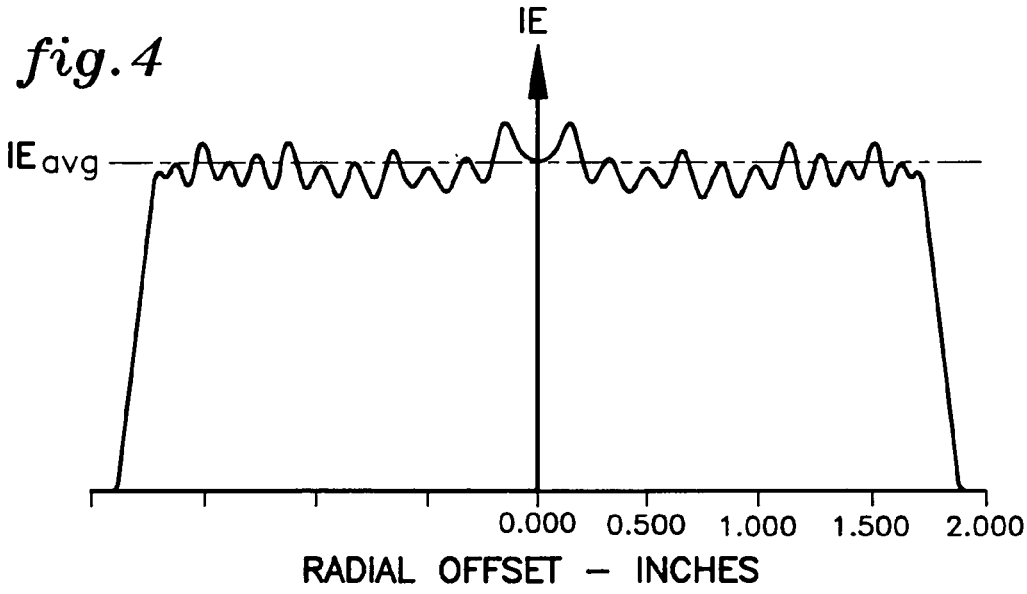
FIG. 4 is an illustration of the incident energy for the nozzle of FIG. 3 once it rotates and traverses the substrate.

Preferred orientation of the orifices and the diameters thereof are determined theoretically via an incident energy profile as shown in FIGS. 2-4 which are meant to be exemplary, not limiting. The number of orifices is based on the size of the substrate, type of honeycomb and braze material to be removed, the required nozzle size, the flow rate attainable with the pump at the desired pressure, and more importantly upon the desired mass flow rate of the spray. Since individual orifice mass flow rate decreases as the orifice diameter decreases, if the diameter of the orifice is too small, the overall mass flow rate from the nozzle can be too low to successfully remove the honeycomb. The orifice diameter is typically up to about 0.05 inches (1.27 mm) with about 0.030 inches (0.762 mm) to about 0.040 inches (1.016 mm) preferred for an about 5 gal/min. (about 1.89 $cm^3$/min) flow rate and about 0.018 inches (0.457 mm) to about 0.024 inches (0.61 mm) preferred for an about 2.5 gal/min. (about 0.946 $cm^3$/min) flow rate.

Individual orifice diameter is also a function of the number of orifices. As the number of orifices increases both the maximum allowable orifice diameter and the flow rate per orifice decreases. As the flow rate through the orifice decreases, the removal rate also decreases due to a decrease in power. Consequently, since the flow rate is limited to equipment (i.e. pump) constraints, the number of orifices is balanced with the desired orifice diameter in order to maintain the desired flow rate and energy per orifice. Typically, the number of orifices is less than 10, often less than 5, and typically 3 or less. In order to maximize the energy and flow capacity of the nozzle, rotating single orifice nozzles are especially preferred, although multiple orifice rotating/non-rotating nozzles can be used.

However, as discussed previously, as a single orifice which is located off-center from the nozzle is rotated and translated, a non-uniform energy profile is generated (see FIG. 3, line 30). To minimize this non-uniform energy profile, careful placement of the orifice from the centerline of the nozzle is required. Placement of the orifice slightly off center reduces the distance between the two maximum peaks at the outer edge of the stripping path and creates a pseudo-uniform energy profile. A nozzle which produces a pseudo-uniform energy profile removes honeycomb without damaging the substrate. The particular offset depends on the orifice diameter and is typically about 0.01 inches (about 0.254 mm) to about 0.1 inch (about 2.54 mm), although about 0.02 to about 0.03 inches (about 0.508 to about 0.762 mm) is preferred.

Additional factors in attaining an even energy distribution of the spray, are the rate of rotation (revolutions per minute, "rpm") and traverse speed. The preferred rpm is a balance between sufficiently rotating the nozzle to attain the even energy distribution while minimizing rotation speed to increase the spray energy. Up to about 500 rpm or more can be used, with about 200 to about 500 rpm preferred, and about 300 to about 400 rpm especially preferred.

The graphs depicted in FIGS. 2-4 were obtained utilizing the following equations:

$$SI_1[X] = \frac{1}{C_1} \times e^{\frac{-(X-X_0)^2}{C_2}} \qquad \text{Equation 1}$$

$$N = \int_{X=0}^{X_0+6\sigma} 2\pi \times \frac{1}{C_1} \times e^{\frac{-(X-X_0)^2}{C_2}} \times dX \qquad \text{Equation 2}$$

$$IE[X] = \int_{Y-0}^{Y-\infty} \frac{1}{C_1 N} \times e^{\frac{-\left(\sqrt{X^2-Y^2}-X_0\right)^2}{C_2}} \times dY \qquad \text{Equation 3}$$

$$IE[X]_{avg} = \frac{1}{\max X_0} \times \int_{X-0}^{\max X_0} \times \sum_{orifice-1}^{orifice-n} IE[X] \times dX \qquad \text{Equation 4}$$

SI=stripping Intensity magnitude $C_1$=constant which is inversely proportional to the cube of the orifice diameter $C_2$=constant $X_0$=orifice offset from the center of the orifice N=area under the cylinder cross section along the X aids IE=incident energy delivered to the surface In addition to producing a substantially uniform energy flow of water, the nozzle is preferably oriented at an angle θ sufficient to prevent the water from entering the face of the honeycomb structure causing the energy of the water to dissipate within the honeycomb. The preferred angle is typically less than about 90° with about 35° to about 65° preferred and about 40° to about 60° especially preferred with relation to the angle between the nozzle and the substrate (see FIG. 1).

The stand-off distance from the nozzle to the substrate is based upon the coherency of the water stream. Typically, the stand-off distance is up to about 12 inches (about 30.48 cm), with up to about 6 inches (about 15.24 cm) preferred, and about 2 inches (about 5.08 cm) to about 4 inches (about 10.16 cm) especially preferred.

It should be noted that if the relative motion between the nozzle and the substrate is too great, i.e. nozzle traverse speed, the water spray will not have sufficient dwell time to clean the honeycomb from the surface thereof. Therefore, the speed which the water traverses the surface of the substrate should be sufficiently slow to allow the water to remove the honeycomb without lingering and thereby damaging the substrate. Although the translation speed can be up to 2 inches per second (in/sec) (about 50.8 millimeters per second (mm/sec), it is typically up to about 0.5 in/sec (about 12.7 mm/sec), with up to about 0.1 in/sec (about 2.54 mm/sec) preferred, and about 0.02 in/sec (about 0.508 mm/sec) to about 0.04 in/sec (about 1.016 mm/sec) especially preferred.

The water pressure exiting the nozzle should be sufficient to remove the honeycomb and preferably the braze, without damaging the underlying substrate. Typically, these pressures are above about 20,000 psi (about 1379 bar), with above about 30,000 psi (about 2068 bar) preferred, and about 35,000 psi (about 2413 bar) to about 60,000 psi (about 4137 bar) especially preferred. The upper pressure limit is dependent upon equipment limitations.

FIG. 1, which is meant to be exemplary, not limiting, shows the removal of honeycomb 1 from a substrate 3. The nozzle 5 which has a stand-off distance 9 from the substrate 3 and an angle θ (see FIG. 2), directs a water spray 7 at the substrate 3. As the nozzle 5 makes a second pass across the substrate 3, it can be oriented such that there is a slight overlap between the first path swath and the second path swath.

The honeycomb is preferably removed such that the water strikes the honeycomb parallel to the direction of the ribbon 1*a*. By striking the honeycomb at a point parallel to the direction of the ribbon 1*a*, the water avoids striking the honeycomb on a flat surface 11 which can cause the energy of the water stream to dissipate.

The invention will be clarified by reference to the following illustrative example. The example is given to illustrate the contaminant removal process of the present invention. It is not, however, intended to limit the generally broad scope of the present invention.

EXAMPLE

The following example has been used to remove HASTELLOY-X honeycomb attached to an engine component segment, with an AMS 4777 (nickel-chrome) braze.

1. A nozzle having a single 0.038 inch (0.965 mm) orifice, 0.13 inch (3.30 mm) bore diameter and 3.05 inch (77.47 mm) bore length was angled at 60° with relation to the substrate and was rotated at 350 rpm.
2. Water at 36,000 psi (2482 bar) and 5 gal/min. (1.89 $cm^3$/min) was passed through the nozzle such that the stream of water struck substrate at the base of the honeycomb, parallel to the direction of the ribbon.
3. Relative motion was created between the water stream and the substrate such that as the honeycomb was removed, the stream advanced to remove additional honeycomb at a translation speed of 0.05 inches/sec (1.27 mm/sec).

Both the honeycomb and braze were successfully removed from the segment without any detrimental damage to the substrate, thereby allowing reuse of the substrate.

Unlike prior art machining processes, the honeycomb removal process of the present invention is flexible enough to process out-of-round parts without damage thereto, is automated, and is much less subject to human error. In addition, this process is environmentally sound; as opposed, for example, to chemical stripping processes.

Although this invention has been shown and described with respect to detailed embodiments thereof, it will be understood by those skilled in the art that various changes in form and detail thereof may be made without departing from the spirit and scope of the claimed invention.

The invention claimed is:

1. A method for removing metal honeycomb and braze from a substrate, said honeycomb having a base and a ribbon direction, comprising: directing a pressurized liquid at an angle of less than about 90° between the liquid and the substrate, through at least one orifice of a nozzle such that the liquid forms a liquid stream upon exiting the nozzle, the liquid stream striking the substrate at the base of the honeycomb, thereby removing the honeycomb and braze from the substrate, whereby the substrate may be reused.

2. A method as in claim 1 further comprising the step of forming a laminar liquid flow out of the nozzle, wherein said nozzle has an orifice and a bore which connects said orifice to a liquid supply, with said bore having sufficient length such that a flow of liquid from said liquid supply attains a laminar flow prior to exiting said orifice.

3. A method as in claim 1 wherein the pressure of the liquid stream is above about 20,000 psi (about 1379 bar).

4. A method of claim 1 wherein the pressure of the liquid stream is above about 30,000 psi (about 2068 bar).

5. A method of claim 1 wherein the pressure of the liquid stream is above 35,000 psi (about 2413 bar) to about 60,000 psi (about 4137 bar).

6. A method as in claim 1 wherein said angle is about 35° to about 65°.

7. A method as in claim 1 wherein said angle is about 40° to about 60°.

8. A method as in claim 1 wherein said liquid stream strikes the base of the honeycomb in the ribbon direction.

* * * * *